United States Patent [19]

Davido, Sr.

[11] 4,157,872

[45] Jun. 12, 1979

[54] MIXING-TANK TRAILER

[76] Inventor: Sammy Y. Davido, Sr., 5008 Muscatel, San Gabriel, Calif. 91776

[21] Appl. No.: 894,825

[22] Filed: Apr. 10, 1978

[51] Int. Cl.[2] ..... B28C 5/08; B01F 7/02

[52] U.S. Cl. ..... 366/64; 366/321

[58] Field of Search ..... 366/64, 96, 97, 99, 366/241, 242, 244, 249, 252, 283, 318, 341, 601, 606, 607, 321

[56] References Cited

U.S. PATENT DOCUMENTS

| | | | |
|---|---|---|---|
| 912,125 | 2/1909 | Hassam | 366/64 |
| 2,509,867 | 5/1950 | Hunkins | 366/64 |
| 3,942,768 | 3/1976 | Hughes | 366/318 |
| 4,071,226 | 1/1978 | Miller | 366/64 |

*Primary Examiner*—Edward J. McCarthy

[57] ABSTRACT

A mixing-tank trailer is provided comprising a trailer frame supported on a differential housing which encloses half-axles having wheels attached on the outer ends thereof. The differential housing includes a central output shaft disposed normal to the half-axles and coupled to be driven by the half-axles through differential gearing. A cylindrical tank disposed lengthwise on the frame is provided with a rotatable internal shaft having mixer blade members attached thereto for mixing a liquid carried in the tank. The internal shaft is coupled for rotation by a reducing gear arrangement driven by the central output shaft which is driven by the rotation of the wheels of the mixing-tank trailer as it is being towed by a vehicle.

9 Claims, 7 Drawing Figures

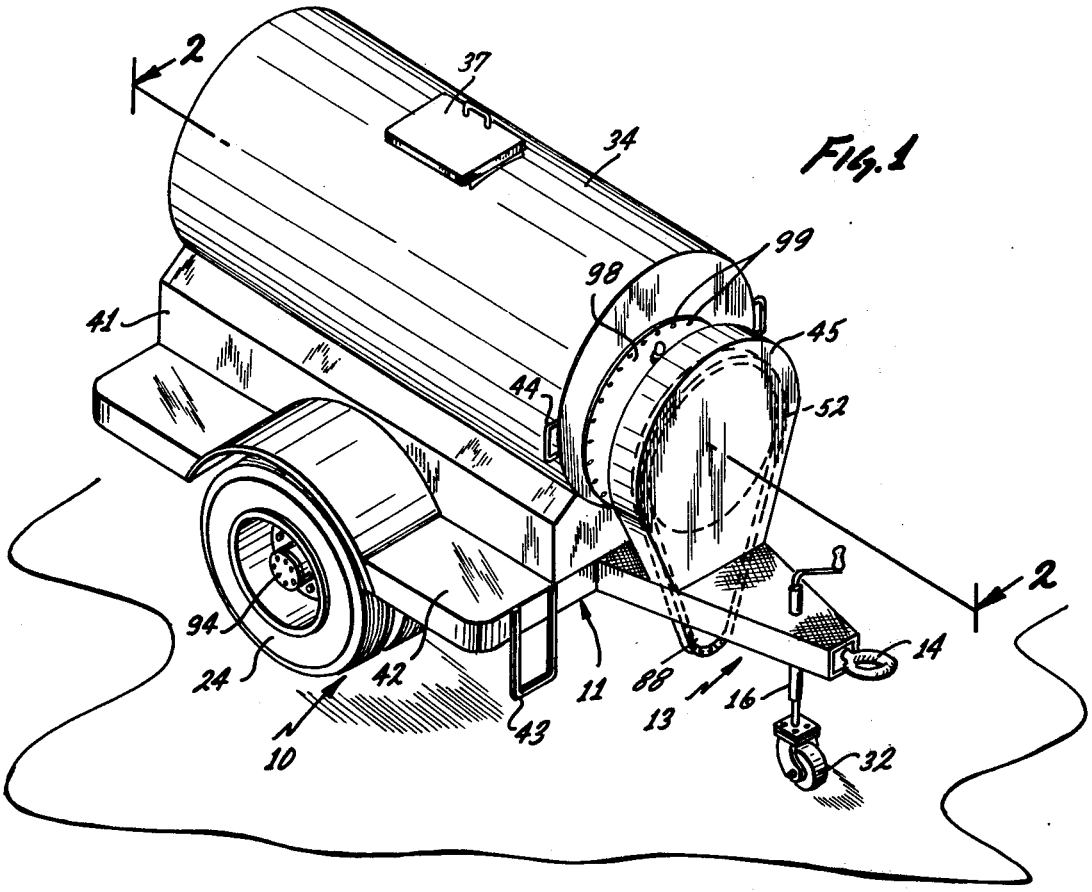
Fig. 1
Fig. 6
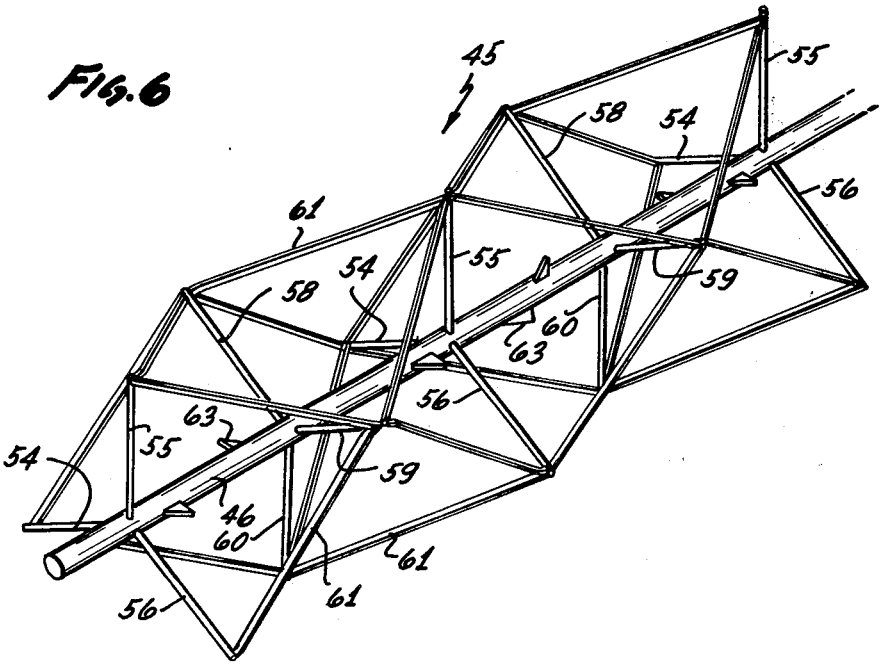

MIXING-TANK TRAILER

BACKGROUND OF THE INVENTION

The invention relates to tank trailers and more particularly to a mixing-tank trailer which provides for mixing a liquid carried in the tank while the trailer is being towed by a vehicle.

When roads or parking lots are being paved with an asphalt covering it is desirable to place a thin coating of a liquid sealer over the surface thereof to improve its wearing quality and appearance. Since it is impractical to produce the liquid sealer at the place of application, it is highly desirable to have tank trailers made available at the production site of the liquid sealer whereby after the tank of the trailer has been filled with the liquid sealer and tightly closed, it can then be towed by means of a vehicle to the location of application. Inasmuch as the liquid sealer has materials in it which tend to settle, it requires mixing before it can be properly applied to the asphalt surface. Hence, it is highly desirable to provide an agitator or mixer in the tank for mixing the liquid sealer while the trailer is being towed from the production site to the area of application.

SUMMARY OF THE INVENTION

In accordance with the present invention, a mixing-tank trailer comprises an elongated trailer frame having a cylindrical tank disposed lengthwise thereon. The tank is provided with a rotatable internal shaft having mixer blade members attached thereto. The trailer frame is supported on a differential housing structure as conventionally provided on rear of trucks including half-axles with wheels on the outer ends thereof and a central shaft coupled to the half-axles by differential gearing. The mixer shaft within the tank and the central shaft of the differential housing are coupled through suitable reduction gearing connectors. With such an arrangement, when the trailer is being towed at the normal speeds on the highway, the wheels of the trailer drive the half-axles which in turn drive the central shaft to thereby drive the mixer shaft at reduced rotational speeds such that the liquid sealer in the tank is available for application when the towing vehicle arrives at the site of application.

Accordingly, one of the objects of the present invention is to provide a mixing-tank trailer having a rotating mixer within the tank thereof which is coupled to be rotated by the wheels of the trailer as the latter is being towed.

Another object of the present invention is to provide a mixing-tank trailer having a rotating mixer within the tank thereof which is connected to be driven by a shaft coupled by differential gearing to half-axles which are rotated by the wheels of the trailer as it is being towed.

Another object of the present invention is to provide a mixing-tank trailer having a rotating mixer within the tank thereof which is driven by the wheels of the trailer as it is being towed and wherein a reduction gearing arrangement is provided to reduce the speed of rotation of the mixer as compared to the speed of rotation of the wheels of the trailer whereby the trailer can be towed at normal road speeds.

Another object of the present invention is to provide a mixing-tank trailer which has a long life and which is constructed so as to be easily maintained and cleaned.

With these and other objects in view, the invention consists in the construction, arrangement, and combination of the various parts of the device, whereby the objects contemplated are attained, as hereinafter set forth, pointed out in the appended claims and illustrated in the accompanying drawings.

BRIEF DESCRIPTION OF THE DRAWINGS

FIG. 1 is a perspective view of the mixing-tank trailer of the present invention;

FIG. 6 is a perspective view of the mixer assembly; and

DETAILED DESCRIPTION OF PREFERRED EMBODIMENT

Figure 2:
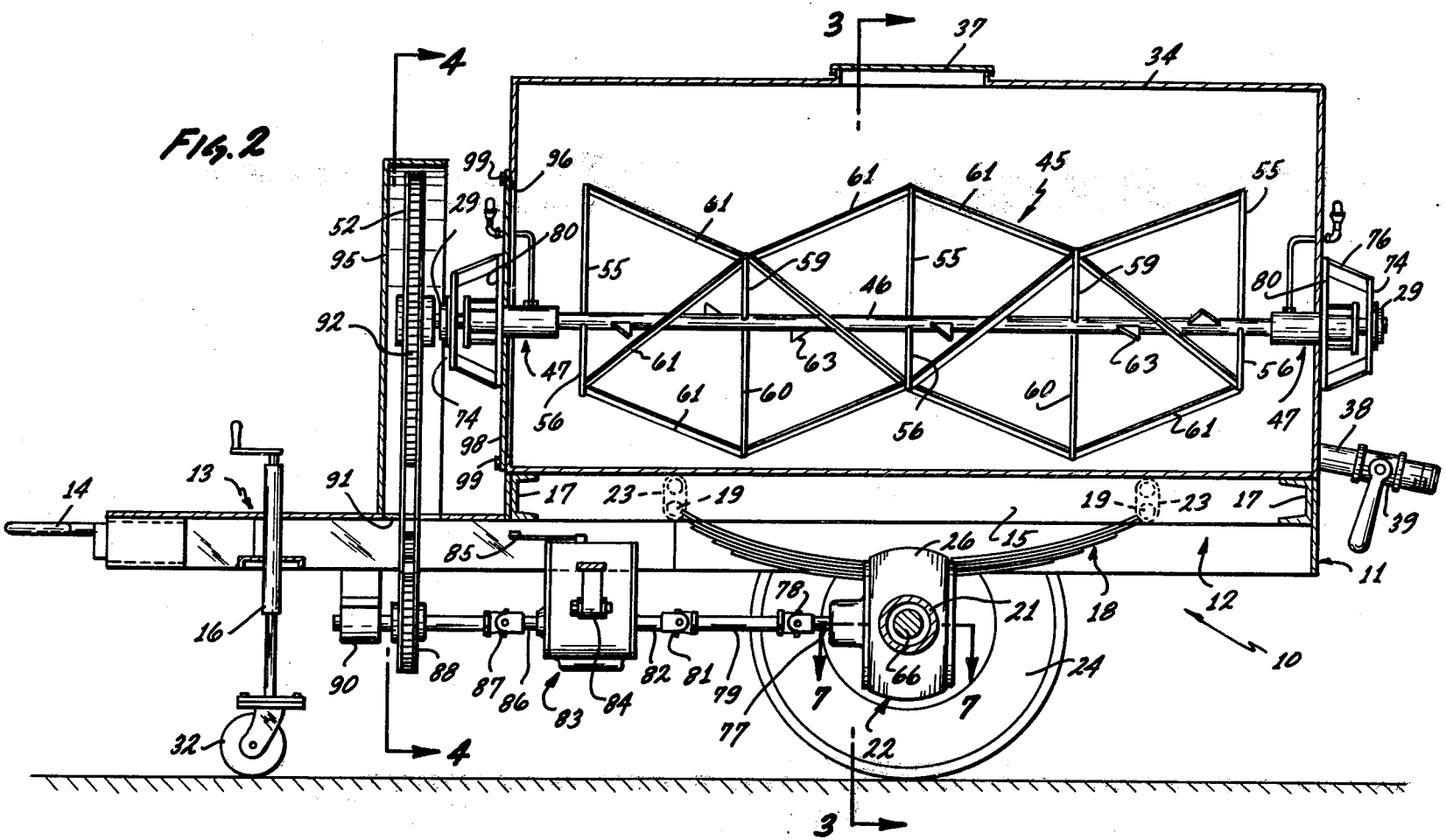
FIG. 2 is a longitudinal sectional view of the apparatus taken along line 2—2 of FIG. 1.
Figure 3:
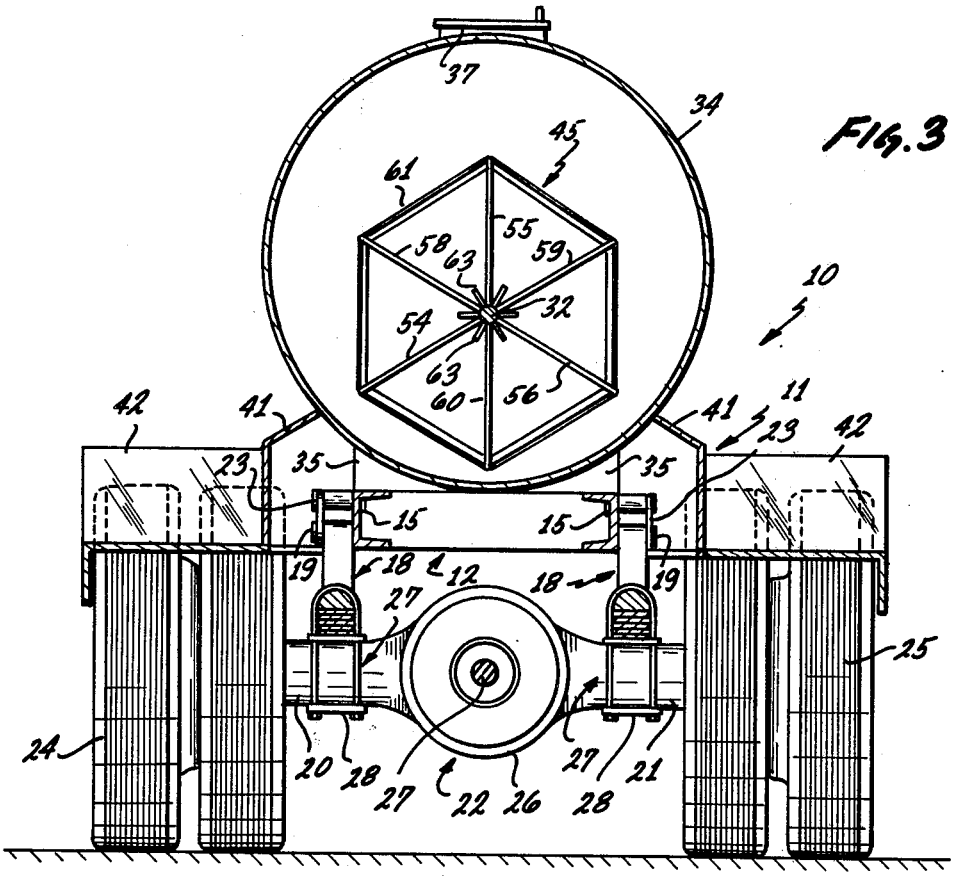
FIG. 3 is a cross sectional view taken along line 3—3 of FIG. 2.

Referring to the drawings, a mixer-tank trailer 10 embodying features of the present invention comprises a trailer bed 11 including a rectangular frame 12 formed of a pair of longitudinal channel members 15 connected together by transverse channel members 17. Attached on the forward end of the rectangular frame 12 is a triangular structure 13 provided with a towing ring 14. As illustrated in FIGS. 2 and 3, a leaf spring assembly 18 is attached by its ends to each side of the rectangular frame 12 by end pins 19 passing through link connectors 23.

Located below the longitudinal center of the rectangular frame 12 is a differential housing 22 of the type as conventionally provided on the rear of a truck, for example. The housing 22 has mounted on the end of the side extensions 20 and 21 thereof dual wheels 24 and 25 with automotive-size tires. The lower central portions of the leaf spring assemblies 18 rest on the tops of the side extensions 20 and 21 of the differential housing 22 and are fastened thereon by passing the threaded ends of U clamps 27 through end-plates 28 and securing the same by nuts 31. A manually retractable vertical leg 16 having a small wheel 32 rotatably carried on its lower end is mounted on the triangular structure 13. The vertical leg 16 is used to support the front end of the tank trailer 10 when unhitched.

Mounted longitudinally on the top of trailer bed 11 is a cylindrical tank 34. The tank 34 is supported on the top of the rectangular frame 12 by wedge plates 35 (FIG. 3) which are welded in position. The tank 34 is provided on the top thereof with a hinged inlet lid 37 and on the bottom rear thereof with an exit pipe 38 having a valve 39.

Figure 4:
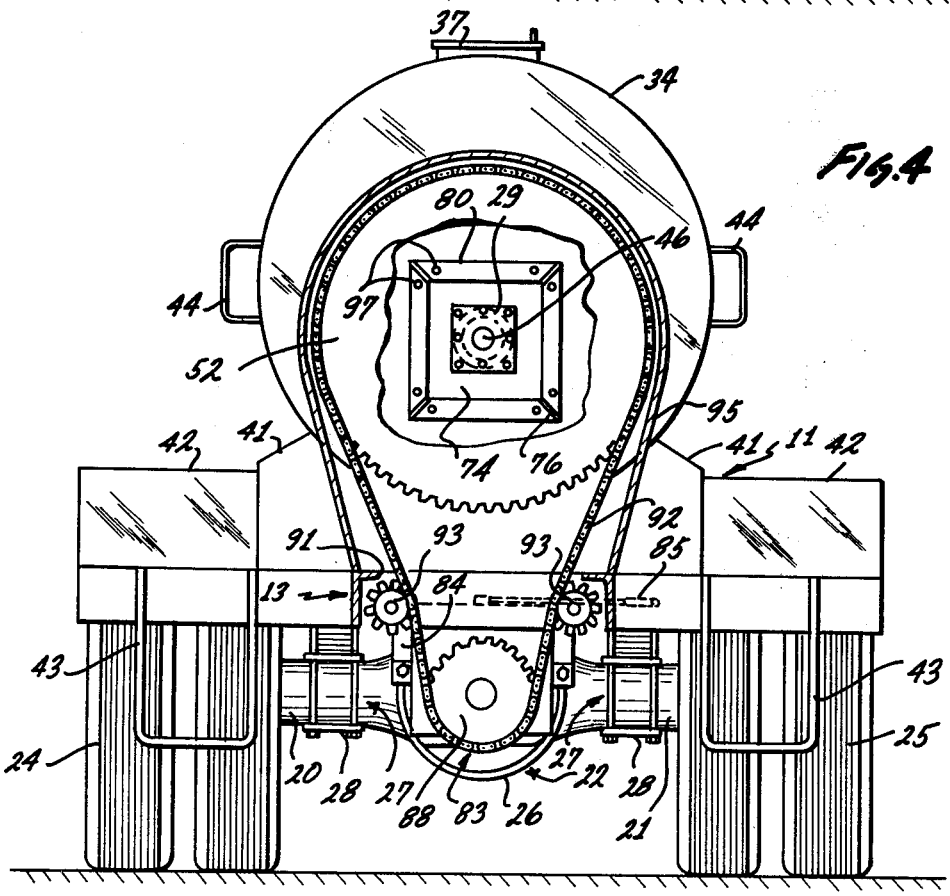
FIG. 4 is a cross sectional view taken along line 4—4 of FIG. 2.

As illustrated in FIGS. 1 and 4, the upper longitudinal sides of the trailer bed 11 adjacent the tank 34 are provided with sheet metal covers 41. In addition, the upper outer longitudinal sides of the trailer bed 11 form sheet metal platforms 42 which extend over the dual wheels 24 and 25. Steps formed of U shaped members 43 are provided on the front sides of the trailer bed 11 and handles 44 are provided on the front sides of the tank 34 to assist the operator in climbing onto the platforms 42 so as to have access to the inlet lid 37 on the top of the tank 34.

Rotatably mounted within the cylindrical tank 34 on an axis located below, but parallel to its longitudinal axis is the shaft 46 of an agitator or mixer assembly 45. The ends of the shaft 46 pass through packing glands 47 and bearing housings 29 attached to each of the end walls of the tank 34. A large sprocket wheel 52 is rigidly attached to the projecting front end of the mixer drive shaft 46.

Figure 5:
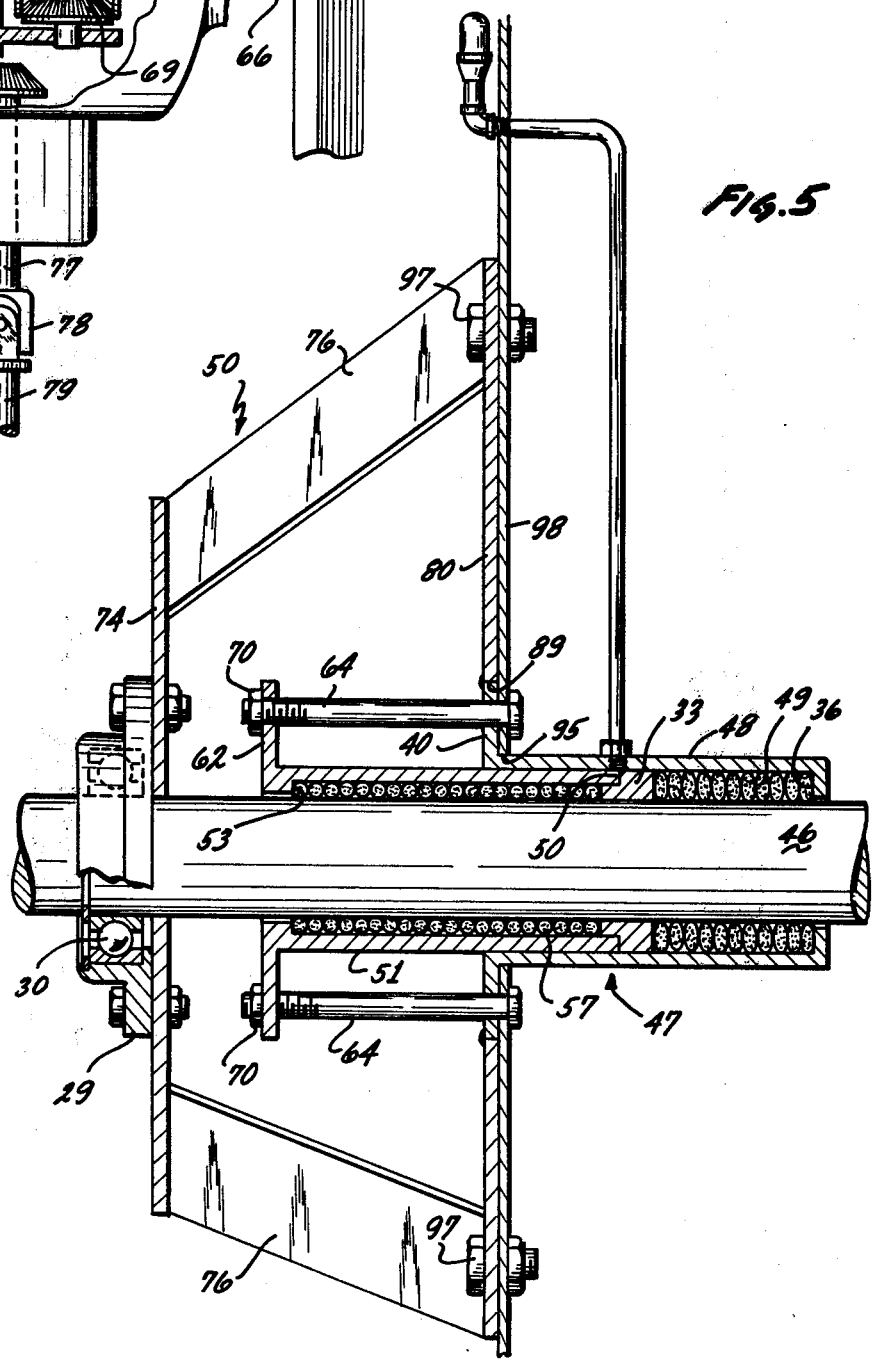
FIG. 5 is a vertical sectional view of the packing gland and bearing support for the front end of the mixer shaft.

As illustrated in FIG. 5, the packing gland 47 on the front end of the tank 34 includes a fixed sleeve 48 which extends through a circular opening 95 on end cover 98 of the tank 34 such that a flange 40 on its end rests against the outer periphery of the opening. The rear end of the fixed sleeve 48 is provided with a lip 36 which serves to retain the end coil of a plurality of turns of packing 49 made of a material such as plumber's rope. A brass collar 33 which slidingly fits within the fixed sleeve 48 abutts against the opposite end coil of the packing 49. The collar 33 is provided with an external shoulder 50.

A movable sleeve 51 slideably fits into the fixed sleeve 48. The front end of movable sleeve 51 is provided with a lip 53 which serves to retain the forward end coil of a packing 57 having a smaller diameter than the packing 49. When the rear end of movable sleeve 51 is seated against the shoulder 50 of collar 33, the rear end coil of the packing 57 abutts against the end of collar 33. The outer end of the movable sleeve 51 is provided with a flange 62 having spaced openings for receiving the threaded ends of the tie-bolts 64 which pass through aligned openings in the flange 40 of the fixed sleeve 48. Nuts 70 are provided on the threaded ends of the tie-bolts 64. As shown in FIGS. 2 and 5, the end of the shaft 46 extends through the sleeve 48 and 51 of the packing gland so as to be sealed by the packings 49 and 57.

In order to rotatably support the end of the shaft 46, the bearing housing 29 for roller bearing 30, through which the end of the shaft 46 extends, is mounted on a smaller outer plate 74 having four corner legs 76 by which it is connected in parallel to a larger inner plate 80. The large inner plate 80 has a circular opening 89 which fits over the flange 40 of the fixed sleeve 48. The inner plate 80 is held onto the cover 98 by nuts and bolts 97. A similarly constructed packing gland 47 and bearing housing 29 are provided on the opposite end wall of the tank 34 for sealing and supporting the opposite end of the shaft 46.

It should now be noted that the bearing housing 29 on which the end of the shaft 46 is rotatably mounted is spaced from the outer end of the tank 34 by the corner legs 76 so as to provide access to the outer end of the packing gland 47. It should now be clear that by this structural arrangement, it is relatively easy to adjust the packing gland 47, as needed from time to time, to assure that it does not leak by tightening the nuts 70 on the tie-bolts 64. This is because the adjustment can be made from the outside of the tank 34 and while the tank 34 is filled with the asphalt liquid sealer.

Referring to FIG. 6, which illustrates the mixer assembly 45, the mixer shaft 46 is provided with a set of three equally angularly spaced radial blade members 54, 55 and 56 disposed adjacent each of the ends and the center thereof. All the radial blade members have the same length and the corresponding radial blade members 54, 55 and 56 of these sets are angularly aligned. Midway between the sets of radial blade members on each half portion of the mixer shaft 46 is an intermediate set of three similar and equally spaced radial blade members 58, 59 and 60. However, the radial blade members of these intermediate sets are advanced sixty degrees with respect to the corresponding radial blade members on either side thereo. The end of each radial blade member in each set is connected by cross blade members 61 to the ends of two radial blade members of the succeeding set along the shaft 46. It is noted that the cross blade members 61 are necessarily inclined with respect to the axis of the shaft 46 and their direction of travel. Thus, upon rotating the mixer shaft 46, the passing of the successive sets of radial blade members through the liquid at different angular times of a revolution together with the inclined advancing of the transverse blade members therethrough serves to mix the liquid by creating differently timed rolling motions therein each quarter length of the shaft 46. Small triangular projections 63 spaced along and angularly about the shaft 46 serve to mix the asphalt liquid sealer in the immediate vicinity thereof. It should be understood that the shaft 46 is disposed below the longitudinal axis of the cylindrical tank 34 such that the mixer radial blade members extend close enough to the bottom of the tank to provide agitation for the liquid carried therein.

Figure 7:
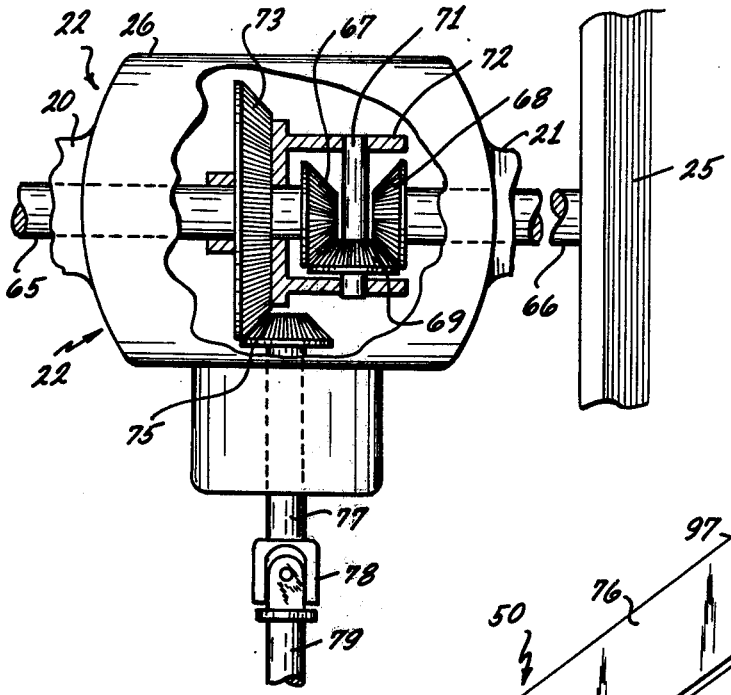
FIG. 7 is a simplified sectional view of a typical differential drive.

The differential housing 22 houses conventional differential gearing in the enlarged central portion 26 thereof and half-axles 65 and 66 on the respective side extensions 20 and 21 thereof. As illustrated in FIG. 7, the differential gearing includes bevel gears 67 and 68 splined on the inner ends of the respective half-axles 65 and 66 and a differential case 72 mounted to rotate on the half-axle 65. The bevel gears 67 and 68 are located to drive a differential pinion gear 69 supported on a shaft 71 rotatably mounted on the differential case 72 so as to thereby rotate the case 72 relative to the half-axle 65 and thereby a ring gear 73 rigidly attached on its side. This ring gear 73, in turn, meshes with a drive pinion 75 attached to the differential output shaft 77 which is disposed at the center of the differential housing 22 with its axis normal to the axes of the half-axles 65 and 66. As shown in FIG. 2, the output shaft 77 is coupled by a first universal joint 78 to a short shaft 79 which is, in turn, coupled by a second universal joint 81 to the input shaft 82 of a transmission box 83 suspended below the frame 13 by side arms 84. The transmission box 83 includes transmission gears. The output shaft 86 of transmission box 83 is, in turn, coupled by a third universal joint 87 to rotate a pinion gear 88 mounted on a bearing support 90 attached below the triangular structure 13. The pinion gear 88 is coupled by a link chain 92, which passes through a slot 91 in triangular structure 13, to drive the sprocket wheel 52 and thereby the mixer shaft 46. As shown in FIG. 4, adjustably mounted idler gears 93 are provided on the sides of the triangular structure 13 to mesh with the sides of the link chain 92 for the purpose of taking up any slack it may have. A hood 95 covers the sprocket wheel 52 and chain 92.

The liquid asphalt sealer produced at the production site generally includes materials of varying consistencies of asbestos, mica, lampblack and oil so as to provide a liquid mixture which may have a viscosity as thick as molasses. When the mixing-tank trailer 10 located at the production site is to be placed into service, its hinged inlet lid 37 is opened to load the tank 34 with a quantity of the liquid asphalt sealer. The inlet lid 37 is then closed to provide an airtight closure. The mixing-tank trailer 10 is then hitched by its towing ring 14 to the rear of a suitable towing vehicle. The solid materials in the asphalt liquid sealer tend to settle and separate if not continually mixed. Thus, while the tank trailer 10 is being towed, the rotating of the dual wheels 24 and 25 causes the half-axles 65 and 66 mounted within the respective side extensions 20 and 21 of the differential housing 72 to rotate, thereby rotating the differential gearing so as to drive the differential output shaft 77. The transmission of this power through the transmission box 83 then drives the pinion gear 88 which, in turn, drives the sprocket wheel 52 rigidly attached to the end of the mixer shaft 46.

The transmission box 83, includes transmission gears and is provided with a control lever 85 accessable from the lower front of the trailer bed 11 which serves to engage or disengage the gears therein and therefore the coupling of the power of the differential output shaft 77 to the transmission output shaft 86. Thus, the mixer shaft 46 can be rotated by the rotation of the wheels 24 and 25 at desired times during the towing of the tank trailer 10.

It should be appreciated that the differential gearing in housing 22 is driven in reverse of the differential gearing as provided on a conventional truck. However, the well known benefits of providing differential gearing on the rear axles of a truck are still present such as the ability of the outer wheels to rotate faster than the inner wheels when rounding a curve, the advantage of easy steering and the ability to remove a broken half axle without disturbing the wheels. In connection with this latter advantage, it should be understood that it is virtually standard practice in differentials for trucks to provide full floating half axles, i.e., to provide half axles which serve to transmit torque without also serving as a support for the truck. Accordingly, in the mixer-tank trailer 10 of the present invention, the half-axles 65 and 66 extend beyond the side extensions 20 and 21 of the housing 22 and carry flanges having projections or dogs (not shown) which mesh tightly with slots cut in the hubs of the wheels in a well known manner and thus are driven by the dual wheels 24 and 25. The advantage of this arrangement in the mixing tank trailer of the present invention is that either of the half-axles 65 and 66 can be readily removed for replacement by merely removing the end covers 94 of the wheels which serve to hold the half-axles in place.

It should be particularly noted that with the arrangement of the present invention both the left and right dual wheels 24 and 25 effectively serve to drive the mixer assembly 45 inasmuch as they are both connected through the differential gearing to the differential output shaft 77 which latter is coupled through the transmission box 83 to supply power to the mixer shaft 46.

To facilitate the cleaning of the tank 34 and the mixer assembly 45, the front end wall of the tank 34 is constructed with a large circular opening 96 having a diameter slightly larger that the outside diameter of the mixer assembly 45. The circular end cover 98 is positioned over opening 96 and held along the periphery thereof by a series of bolts 99. The advantage of this construction is that by merely disengaging the chain link 92 from the sprocket wheel 52, the entire mixer assembly 45 including its shaft 46, together with the end cover 98, the front packing gland 47, the front bearing housing 29, and the sprocket wheel 92 can be removed as a unit out of the opening 96 on the front end of the tank 34.

It should be noted that because of the gear reduction provided primarily by the large sprocket wheel 52, the speed of rotation of the agitator drive shaft 46 is considerably less than the speed of rotation of the dual wheels 24 and 25. Thus when the mixing-tank trailer 10 is being towed at normal speeds the resistance to the movement of the large diameter mixer blade members in the liquid asphalt sealer carried in the tank does not become excessive so as to restrict the speed of the towing vehicle to below normal road speeds.

It should now be appreciated that the mixing-tank trailer 10 provides a means for a party having need for a quantity of the liquid asphalt sealer to employ his own vehicle to economically and efficiently transport the liquid sealer from a production site to an area of application. Moreover, the mixing-tank trailer 10 has been ruggedly designed so as to have a long life and has been especially designed so as to be easily cleaned and maintained. Furthermore, because of the connection of the mixer assembly 45 to the wheels 24 and 25 of the mixing-tank trailer 10, the liquid sealer arrives at the worksite with the smooth consistency needed for its application to the asphalt surface to be coated.

While in order to comply with the statute the invention has been described in language more or less specific as to structural features, it is to be understood that the invention is not limited to the specific features shown but that the means and construction herein disclosed comprise a preferred form of putting the invention into effect, and the invention is therefore claimed in any of its forms or modifications within the legitimate and valid scope of the appended claims.

What is claimed is:

1. A mixing-tank trailer comprising:

a trailer frame provided with a hitch on the front thereof for engaging a towing vehicle;

a differential housing having wheels on the side ends thereof for supporting said trailer frame, said differential housing including half-axles in the sides thereof engaging said wheels, a differential output shaft disposed normal to the axes of said half axles, and differential gearing for coupling the inner ends of said half axles and said differential output shaft;

a tank mounted on said trailer frame, said tank having a mixer shaft encompassed by mixing blade members mounted for rotation therein; and reduction gearing means for drivingly connecting the differential output shaft to the mixer shaft;

whereby as said mixing-tank trailer is being towed its wheels rotate the half-axles to drive the differential output shaft and thereby the mixer shaft to mix the liquid carried in the tank.

2. A mixing-tank trailer as defined in claim 1 wherein said reduction gearing means includes a sprocket wheel on the end of said mixer shaft and a pinion gear coupled to the end of said differential output shaft, and a link chain coupling said pinion gear and said sprocket wheel.

3. A mixing-tank trailer as defined in claim 1 including transmission gears between the differential output shaft and the pinion gear, and a lever operable to engage or disengage said transmission gears.

4. A mixing-tank trailer as defined in claim 1 wherein said tank is generally cylindrical in shape and mounted on said trailer frame with its axis disposed normal to the axes of said half-axles.

5. A mixing-tank trailer as defined in claim 1 wherein the ends of said mixer shaft extend through packing glands located on the opposite end walls of said tank and wherein said mixer shaft is mounted for rotation on bearing supports mounted to project out from the opposite end walls of said tank.

6. A mixing-tank trailer as defined in claim 5 wherein a circular opening is provided on the front end wall of said tank, said opening being of a slightly larger diameter than the outside diameter of said mixer blade members, and wherein the packing gland and bearing support for the front end of said mixer shaft are provided on said circular plate.

7. A mixing-tank trailer as defined in claim 1 wherein said trailer frame is mounted on the sides of said differential housing by leaf spring assemblies.

8. A mixing-tank trailer comprising:

an elongated trailer frame including a forward triangular portion provided with means for hitching said trailer frame to a towing vehicle;

an axle means transversely disposed and connected below said elongated trailer frame;

wheels connected to the outer ends of said axle means for supporting said trailer frame;

an output shaft disposed below said elongated trailer frame and normal to the axis of said axle means;

bevel gears for coupling said axle means to said output shaft;

a cylindrically shaped tank having inlet and outlet means and mounted on said trailer frame with its longitudinal axis extending horizontally parallel to the axis of said output shaft;

a mixer shaft extending horizontally within said tank with its opposing ends mounted for rotation at the opposite end walls of said tank, said mixer shaft having mixing blade members attached thereto; and gear reduction means coupling said output shaft and said mixer shaft whereby as said trailer frame is being towed by a vehicle said mixer shaft is rotated at a speed substantially less than the rotation of the wheels supporting said trailer frame.

9. A mixing-tank trailer comprising:

an elongated trailer frame including a forward triangular portion provided with means for hitching said trailer frame to a towing vehicle;

a differential transversely disposed and connected below said elongated trailer frame, said differential including half-axles, an output shaft disposed normal to the axes of said half axles, and differential gearing for coupling said half axles and said output shaft;

wheels connected to the outer ends of said half-axles for supporting said trailer frame;

a cylindrically shaped tank having inlet and outlet means and mounted on said trailer frame with its longitudinal axis extending horizontally in the direction of the axis of said output shaft;

a mixer shaft extending horizontally within said tank with its opposing ends mounted for rotation at the opposite end walls of said tank, said mixer shaft having mixing blade members attached thereto; and gear reduction means coupling said output shaft and said mixer shaft whereby as said trailer frame is being towed by a vehicle said mixer shaft is rotated at a speed substantially less than the rotation of the wheels supporting said trailer frame.

* * * * *